US009134676B2

(12) United States Patent
Yoshimura et al.

(10) Patent No.: US 9,134,676 B2
(45) Date of Patent: Sep. 15, 2015

(54) IMAGE FORMING APPARATUS

(71) Applicant: Konica Minolta, Inc., Tokyo (JP)

(72) Inventors: Osamu Yoshimura, Toyokawa (JP); Masahiro Matsuo, Kokubunji (JP); Yoshiteru Kawakami, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 72 days.

(21) Appl. No.: 13/952,701

(22) Filed: Jul. 29, 2013

(65) Prior Publication Data

US 2014/0064813 A1 Mar. 6, 2014

(30) Foreign Application Priority Data

Sep. 4, 2012 (JP) ..... 2012-193678

(51) Int. Cl.
*G03G 15/00* (2006.01)

(52) U.S. Cl.
CPC ..... *G03G 15/6529* (2013.01); *G03G 15/657* (2013.01)

(58) Field of Classification Search
CPC .. G03G 15/00; G03G 15/6529; G03G 15/657
USPC ..... 399/388, 394, 396
See application file for complete search history.

(56) References Cited

U.S. PATENT DOCUMENTS 5,428,431 A * 6/1995 Abe et al. ..... 399/396
5,602,636 A 2/1997 Matsuzawa
7,409,172 B2 * 8/2008 Koshida ..... 399/68
2002/0061214 A1 * 5/2002 Miyaki et al. ..... 399/396
2006/0251439 A1 * 11/2006 Sugiyama ..... 399/68
2009/0324305 A1 * 12/2009 Udaka et al. ..... 399/302
2012/0057913 A1 * 3/2012 Kawachi et al. ..... 399/394
2012/0107001 A1 * 5/2012 Dobbertin et al. ..... 399/68

FOREIGN PATENT DOCUMENTS

JP 06080273 A * 3/1994 ..... G03G 15/00
JP H07-261573 10/1995
JP 08-108956 A 4/1996
JP 08108956 A * 4/1996 ..... G03G 15/00
JP H08-230302 9/1996

(Continued)

OTHER PUBLICATIONS

Rejection Notice issued Nov. 18, 2014 by JPO for corresponding Japanese Patent Application No. 2012-266993.

(Continued)

*Primary Examiner* — Nguyen Ha
(74) *Attorney, Agent, or Firm* — Lucas & Mercanti, LLP

(57) ABSTRACT

An improved image forming apparatus is described in which, even when a conveyance unit is switched from a pressure engaged state to a disengaged state, misalignment of a sheet during conveyance can be inhibited. A control unit conveys a sheet between a transfer unit and paper stop rollers, while forming a loop of the sheet therebetween, by setting the speed of conveying the sheet passing between the paper stop rollers to be higher than the speed of conveying the sheet passing through the transfer unit. In addition to this, when the pair of rollers serving as the paper stop rollers are switched from a pressure engaged state to a disengaged state, the paper stop rollers are controlled to reduce the speed of conveying the sheet therethrough in advance of this switching operation.

6 Claims, 4 Drawing Sheets

(56) References Cited

FOREIGN PATENT DOCUMENTS

| | | | |
|---|---|---|---|
| JP | 2003-316092 | A | 11/2003 |
| JP | 2004-323198 | A | 11/2004 |
| JP | 2008-001447 | A | 1/2008 |
| JP | 2012-162350 | A | 8/2012 |

OTHER PUBLICATIONS

Office Action dated Apr. 7, 2015 for the corresponding Japanese Patent Application No. 2012-193678.
English translation of Office Action dated Apr. 7, 2015 for the corresponding Japanese Patent Application No. 2012-193678.

* cited by examiner

IMAGE FORMING APPARATUS

CROSS-REFERENCE TO RELATED APPLICATIONS

The present application claims priority under 35 U.S.C. §119 to Japanese Patent Application No. 2012-193678, filed Sep. 4, 2012. The contents of this application are herein incorporated by reference in their entirety.

FIELD OF THE INVENTION

The present invention relates to an image forming apparatus.

DESCRIPTION OF THE RELATED ART

Heretofore, image forming apparatuses such as printers, copying machines and so forth are known as electrophotographic systems. When printing an image on a sheet by this image forming apparatus, the sheet sometimes laterally moves during conveyance, i.e., the sheet is sometimes displaced from a predetermined correct position in the sheet width direction (the direction perpendicular to the sheet conveying direction). In this case, there is a problem that the print quality is degraded due to misalignment of printed images from appropriate positions in a sheet. Some image forming apparatus is provided with a shifting device which shifts a sheet in the sheet width direction in order that the position of the sheet P during conveyance, is appropriately adjusted by driving the shifting device in synchronism with conveyance of the sheet. This shifting device can be implemented a dedicated mechanism, or rollers which function as sheet conveyance units (for example, as described in Japanese Patent Published Application No. H08-108956).

Also, some image forming apparatus drives an upstream sheet conveyance unit and a downstream sheet conveyance unit, which are adjacent to each other, in order that the conveyance speed of the upstream sheet conveyance unit is higher than that of the downstream sheet conveyance unit. The sheet conveyed by these conveyance units is thereby warped therebetween in the form of a loop. By this configuration, the sheet is prevented from being pulled between the adjacent conveyance units and being damaged or scratched by these conveyance units.

Generally speaking, the conveyance unit consists mainly of a pair of rotary members which are engaged with each other under pressure. The pair of rotary members may be disengaged from each other when the conveyance scene requires. In this case, if the sheet is held by two conveyance units and warped therebetween and then the rotary members of one conveyance unit are disengaged, the stress exerted on the sheet is released so that the sheet is supported only by the other conveyance unit, and the orientation of the sheet during conveyance may be substantially disturbed. Such disturbed conveyance orientation may result in misalignment of the sheet during conveyance and then result, e.g., in a disturbed image printed on the sheet in the transfer site.

The present invention has been made in order to solve the problem as described above. It is an object of the present invention therefore to avoid misalignment of sheets during conveyance even when switching a pair of rotary members between a pressure engaged state and a disengaged state.

SUMMARY OF THE INVENTION

To achieve at least one of the abovementioned objects, an image forming apparatus reflecting one aspect of the present invention comprises: a first conveyance unit provided with a pair of rotary members capable of switching between a pressure engaged state and a disengaged state, and configured to convey a sheet; a second conveyance unit located on a conveyance route of the sheet in the downstream side of said first conveyance unit, provided with a pair of rotary members, and configured to convey the sheet; and a control unit configured to control said first conveyance unit and said second conveyance unit. In this case, said control unit controls said first conveyance unit and said second conveyance unit in order that the speed of conveying the sheet by said first conveyance unit is higher than the speed of conveying the sheet by said second conveyance unit so that a loop is formed between said first conveyance unit and said second conveyance unit, and that when the pair of rotary members of said first conveyance unit is switched from the pressure engaged state to the disengaged state, the speed of conveying the sheet by said first conveyance unit is reduced in advance of this switching operation.

It is preferred here that the image forming apparatus further comprises: a transfer unit configured to transfer an image to a sheet; and a flying unit configured to fix the image transferred to the sheet by said transfer unit. In this case, said first conveyance unit consists of paper stop rollers located in the upstream side of said transfer unit, and said second conveyance unit consists of an image bearing member and an image transfer member which are provided to form a nip portion at said transfer unit.

Also, it is preferred that said control unit is configured to control conveyance of a sheet in order that a loop is formed also between said transfer unit and said fixing unit.

Furthermore, it is preferred that said paper stop rollers are capable of shifting from a predetermined home position as an initial position in the sheet width direction that is perpendicular to the sheet conveying direction, and that said control unit shifts said paper stop rollers in the sheet width direction from said home position in accordance with the position of the sheet during conveyance, switches said paper stop rollers from the pressure engaged state to the disengaged state after the sheet arrives the nip portion of said transfer unit, and then resets said paper stop rollers to the home position.

Furthermore, it is preferred that when the speed of conveying a sheet is reduced, said control unit variably sets the amount of speed reduction in accordance with the type of the sheet.

Furthermore, it is preferred that when the speed of conveying a sheet is reduced, said control unit variably sets the amount of speed reduction in accordance with ambient information including the temperature and/or humidity in the image forming apparatus.

DETAILED DESCRIPTION OF THE PREFERRED EMBODIMENT

Figure 1:
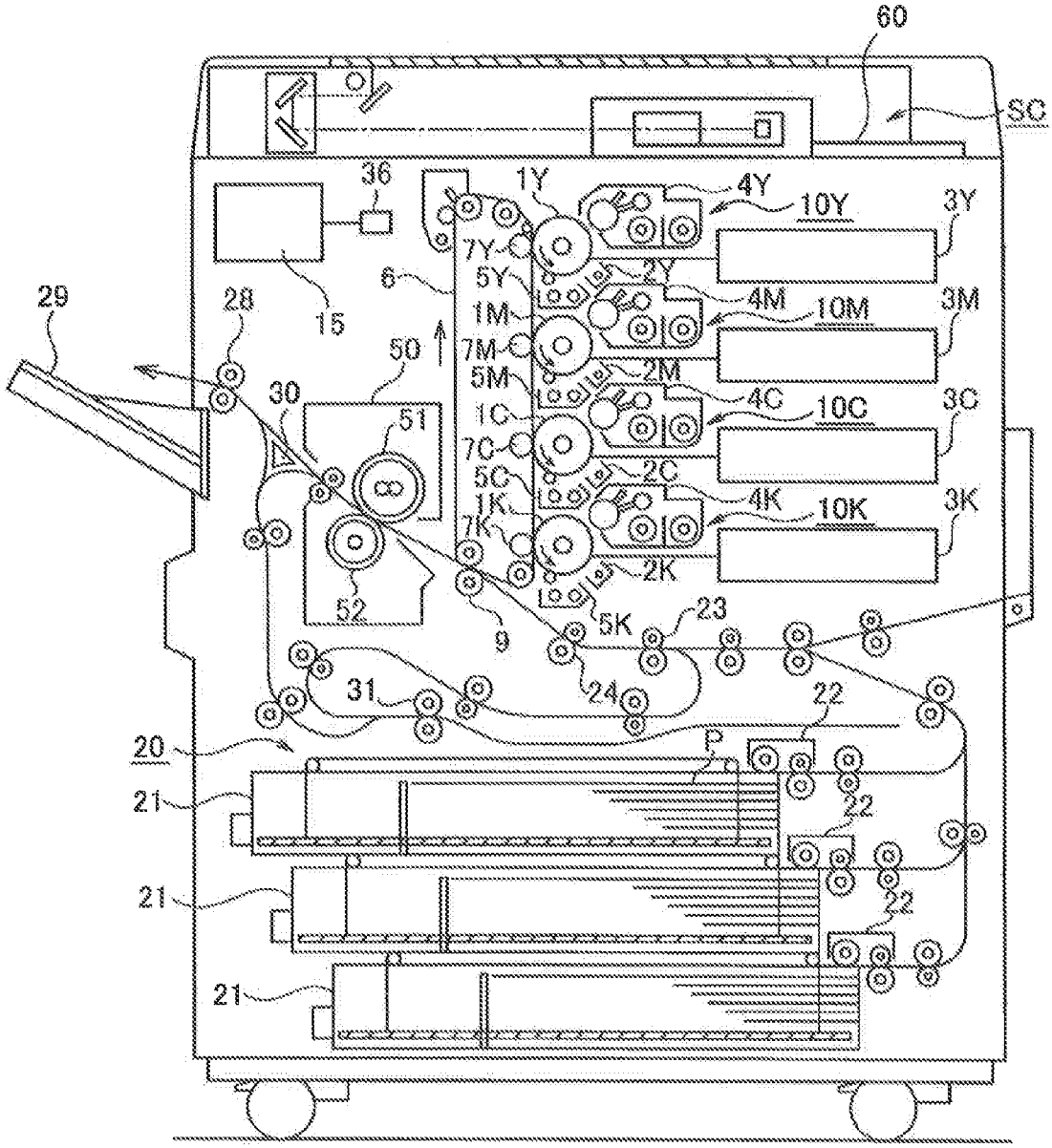
FIG. 1 is a view for schematically showing an image forming apparatus in accordance with the present invention.

FIG. 1 is a view for schematically showing the configuration of an image forming apparatus according to the present embodiment. This image forming apparatus is a copying machine which is an electrophotographic image forming apparatus called a tandem color image forming apparatus. The tandem color image forming apparatus includes a plurality of photoreceptor drums vertically arranged in contact with one intermediate transfer belt to form full-color images.

The image forming apparatus consists mainly of an original reading unit SC, four image forming units 10Y, 10M, 10C and 10K, a fixing unit 50, and a control, unit 15, which are installed within one housing.

The original reading unit SC scans and exposes the image of an original with an optical system of a scanning exposing device, and reads the reflected light therefrom with a line image sensor to obtain image signals. The image signals are processed by performing A/D conversion, shading compensation, data compression and so on, and input to a control unit 15 as image data. Incidentally, the image data input to the control unit 15 is not limited to the image data as captured by the original reading unit SC, but can be the data for example as received from another image forming apparatus, a personal computer or the like connected to the image forming apparatus.

The four image forming units 10Y, 10M, 10C and 10K are an image forming unit 101 for forming yellow (Y) images, an image forming unit 10M for forming magenta (M) images, an image forming unit 10C for forming cyan (C) images, and an image forming unit 10K for forming black (K) images.

The image forming unit 10Y is provided with a photoreceptor drum 1Y, and a charging unit 2Y, an optical writing unit 3Y, a development apparatus 4Y and a drum cleaner 5Y which are arranged around the photoreceptor drum 1Y. Likewise, the other image forming units 10M, 10C and 10K are provided with photoreceptor drums 1M, 1C and 1K, and charging units 2M, 2C and 2K, optical writing units 3M, 3C and 3K, development apparatuses 4M, 4C and 4K, drum cleaners 5M, 5C and 5K which are arranged around the photoreceptor drums 1M, 1C and 1K respectively.

The surfaces of the photoreceptor drums 1Y, 1M, 1C and 1K are uniformly charged with electricity by the charging units 2Y, 2M, 2C and 2K, and the optical writing units 3Y, 3M, 3C and 3K performs a scanning exposure process to form latent images on the photoreceptor drums 1Y, 1M, 1C and 1K. The development apparatuses 4Y, 4M, 4C and 4K then make visible the latent images on the photoreceptor drums 1Y, 1M, 1C and 1K by developing the images with toners. Predetermined color images (toner images) are thereby formed on the photoreceptor drums 1Y, 1M, 1C and 1K respectively corresponding to yellow, magenta, cyan and black. The images formed on the photoreceptor drums 1Y, 1M, 1C and 1K are transferred to a predetermined location of an intermediate transfer belt 6, which is a rotary member in the form of an endless belt, through first transfer rollers 7Y, 7M, 7C and 7K.

After transferred to the intermediate transfer belt 6, the predetermined color images are transferred by a second transfer roller 9, which is a rotary member in the form of a roller, to a sheet P conveyed with a predetermined timing by a paper feed unit 20 to be described below. This second transfer roller 9 and the intermediate transfer belt 6 are arranged in contact with each other and urged against each other to form a nip portion (hereinafter referred to also as "transfer nip portion") therebetween to transfer an image to the sheet P during conveyance. In the case of this embodiment, from the view point of the sheet P serving as an image receiving member, the intermediate transfer belt 6 as an image bearing member and the second transfer roller 9 as an image transfer member correspond to a transfer unit for transferring an image to the sheet P.

The paper feed unit 20 conveys a sheet P along a conveyance route. Sheets P are stored in paper feed trays 21, extracted from the paper feed tray 21 and transferred to the conveyance route by pick-up units 22.

This conveyance route is provided with a plurality of conveyance units for conveying sheets P in the upstream side of the transfer nip portion. Each conveyance unit consists of a pair of rollers which are in contact with each other under pressure, and at least one of the rollers is rotationally driven by a driving mechanism which consists mainly of an electric motor. Then, each conveyance unit holds a sheet P between the pair of rollers which are rotated to convey the sheet P. In the case of the present embodiment, there are a plurality of intermediate conveyance rollers, loop rollers 23 and paper stop rollers 24 as conveyance units on the conveyance route before the transfer nip portion. The pair of rollers serving as a conveyance unit is provided in order to switch between pressure engaged state and a disengaged state. Meanwhile, in place of a pair of rollers, any other appropriate combination such as a combination of belts, a combination of a belt and a roller or the like combination can be used as a pair of rotary members serving as a conveyance unit.

A sheet P supplied from the paper feed tray 21 through this conveyance route is conveyed by the plurality of plurality intermediate conveyance rollers and the loop rollers 23 provided successively from the upstream side to the downstream side, and proceeds on the conveyance route. When the leading edge of a sheet P approaches the paper stop rollers 24, the intermediate conveyance rollers located in the upstream side of the loop rollers 23 are switched from a pressure engaged state to a disengaged state. Because of this, the sheet P is conveyed only by the loop rollers 23 after the intermediate conveyance rollers are switched to the disengaged state. Thereafter, the sheet P conveyed by the loop rollers 23 collides with the paper stop rollers 24, which are not rotated in a halting state, to form a loop of the sheet P (slack in the form of a loop) by continuing the rotation of the loop rollers 23. The misalignment of the sheet P can be corrected by this loop formation (skew correction of the sheet P).

Next, when the paper stop rollers 24 start rotating with a predetermined timing in synchronization with the image carried on the intermediate transfer belt 6, the loop rollers 23 are switched from a pressure engaged state to a disengaged state in the same manner as the intermediate conveyance rollers. That is, the sheet P is conveyed only by the paper stop rollers 24 after the loop rollers 23 are switched to the disengaged state. These paper stop rollers 24 convey the sheet P to the transfer nip portion while performing a shifting operation to be described below.

Figure 2:
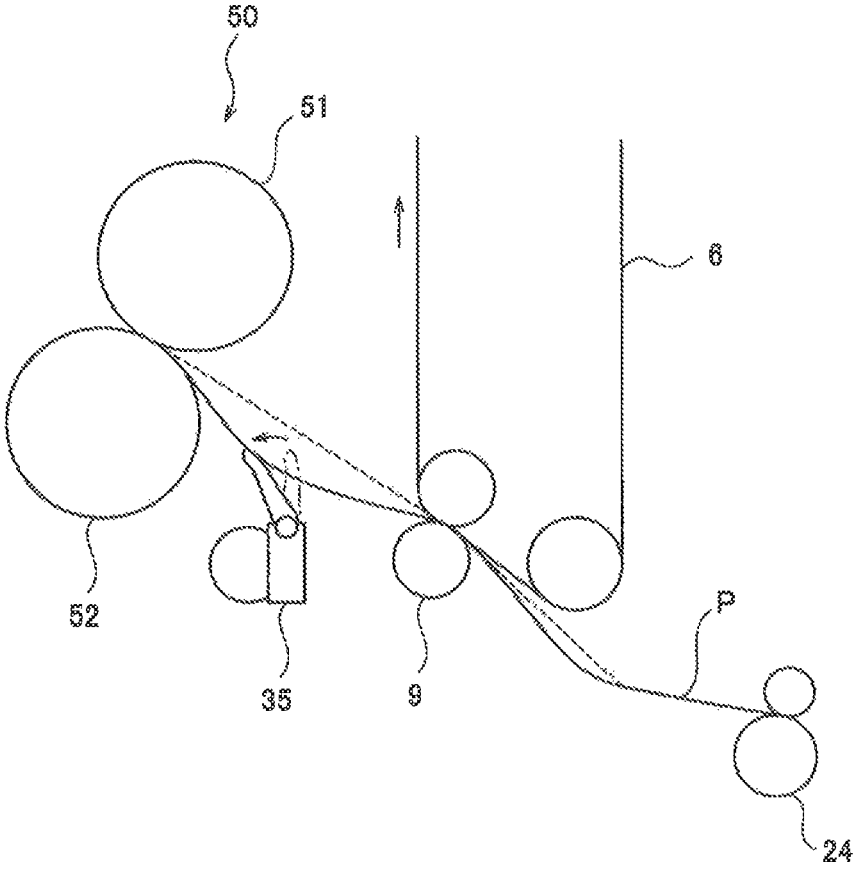
FIG. 2 is an explanatory view for showing the key parts of a sheer conveyance route in the image forming apparatus shown in FIG. 1.

In the case of the present embodiment, the paper stop rollers 24 are capable of shifting in the sheet width direction perpendicular to the sheet conveying direction (i.e., perpendicular to the drawing sheet of FIG. 2). These paper stop rollers 24 are connected to a drive mechanism which consists mainly of an electric motor. The paper stop rollers 24 can be driven by the drive mechanism to shift from a predetermined home position as an initial position in the sheet width direction.

The paper stop rollers 24 can shift a sheet P in the sheet width direction by shifting itself in the sheet width direction during the conveyance period (transit period) of the sheet P. In the case where the position of the sheet P during conveyance is displaced, the paper stop rollers 24 adjust the position of the sheet P during conveyance in the sheet width direction to align with the position of the image transferred to the intermediate transfer belt 6 (shifting operation). On the other hand, after the sheet P arrives at the transfer nip portion, the pair of rollers engaged under pressure are switched to the disengaged state, and then the paper stop rollers 24 return to the home position.

In the case of the present embodiment, the paper stop rollers 24 serve as a first conveyance unit which is provided with a pair of rotary members capable of switching between a pressure engaged state and a disengaged state, and configured to convey a sheet P. The intermediate transfer belt 6 and the second transfer roller 9 serve as a second conveyance unit which is located on a conveyance route of the sheet P in the downstream side of the first conveyance unit, provided with a pair of rotary members, and configured to convey the sheet P.

Returning to FIG. 1 again, the fixing unit 50 is a device which performs a fixing process for fixing an image to a sheet P conveyed from the transfer nip portion, and consists for example of a pair of rollers 51 and 52 which are in contact with each other under pressure and a heater for heating either or both of the fixing rollers 51 and 52. This fixing unit 50 fixes an image to a sheet P (as a fixing treatment) under the pressure applied by the nip portion and the heat applied through a fixing member when the sheet P is conveyed to pass through the nip portion between the pair of fixing rollers 51 and 52.

After the fixing unit 50 processes the sheet P by the fixing treatment, the sheet P is discharged by discharging rollers 28 to a catch tray which is attached to the external side of the housing. In the case where an image is to be formed also on the back side or the sheet P, the sheet P with the image formed on the front side is conveyed reversing rollers 31 located below by a switching gate 30. The reversing rollers 31 hold the tail end of the sheet P which is conveyed therebetween and then reverses the sheet P by sending back it to a refeeding conveyance route. The sheet P directed to the refeed conveyance route is then returned to the transfer site again by a plurality of conveyance rollers provided for refeeding sheets. Incidentally, the discharging rollers 28, the switch gate 30, the reversing rollers 31 and the conveyance rollers provided for refeeding sheets function also as part of the paper feed unit 20.

The control unit 15 functions to integrally control the forming apparatus, and implemented with a computer provided with a CPU, a ROM, a RAM, a memory, an HDD (Hard Disk Drive), a communication I/F and the like which are connected to each other through a bus.

The control unit 15 forms an image on a sheet P by controlling the components of the image forming apparatus (for example, the image forming units 10Y, 10M, 10C and 10K, the paper feed unit 20, the fixing unit 50 and so forth) to perform the following operations, i.e., (1) charging the photoreceptor drums 1Y, 1M, 1C and 1K, (2) forming electrostatic latent images on the photoreceptor drums 1Y, 1M, 1C and 1K with the optical writing units 3Y, 3M, 3C and 3K, (3) making toners adhere to the electrostatic latent images as formed, (4) transferring the electrostatic latent images from the photoreceptor drums 1Y, 1M, 1C and 1K to the intermediate transfer belt 6 as a first transfer process, (5) conveying a sheet P by the paper feed unit 20, (6) transferring the image from the intermediate transfer belt 6 to the sheet P as a second transfer process, and (7) fixing the image transferred to the sheet P by the fixing unit 50.

On the other hand, the control unit 15 performs the shifting operation to shift the paper stop rollers 24 from the home position in accordance with the misalignment of the sheet P. Then, after the sheet P arrives at the transfer nip portion, the control unit 15 switches the pair of rollers serving as the paper stop rollers 24 from a pressure engaged state to a disengaged state, followed by resetting the paper stop rollers 24 to the home position. The pair of rollers serving as the paper stop rollers 24 are switched to the disengaged state with a switching timing which is predetermined in accordance with the size of the sheet P and the specifications of the image forming apparatus in order that the paper stop rollers 24 can be reset to the home position before the subsequent sheet P arrives at the paper stop rollers 24.

The control unit 15 of the present embodiment sets the speed of conveying the sheet P passing between the paper stop rollers 24 to be higher than the speed of conveying the sheet P passing through the transfer nip portion. Thereby, the control unit 15 can convey the sheet P between the transfer nip portion and the paper stop rollers 24 while forming a loop of the sheet P therebetween as illustrated in FIG. 2. Then, when the pair of rollers serving as the paper stop rollers 24 are switched from the pressure engaged state to the disengaged state as described above, the control unit 15 controls the paper stop rollers 24 to reduce the speed of conveying the sheet P through the paper stop rollers 24 in advance of this switching operation.

Furthermore, as illustrated in FIG. 2, the control unit 15 conveys the sheet P between the transfer nip portion and the nip portion of the fixing unit 50 while forming a loop of the sheet P also therebetween. For this purpose, the control unit 15 drives the pair of fixing rollers 51 and 52 of the fixing unit 50 to variably control the speed of conveying a sheet P in accordance with formation of the loop.

The control unit 15 receives information from sensors and so forth in order to perform such a control. For example, there are a plurality of sheet sensors (e.g., photo interrupters, photo reflectors) for detecting a sheet P on the conveyance route, and thereby the control unit 15 can manage the conveyance of a sheet P on the conveyance route on the basis of sheet detection information output from the sheet sensors respectively.

Also, the misalignment amount of a sheet P is detected by a misalignment sensor. The misalignment sensor can be implemented with a linear image sensor (for example, CCD line sensor) consisting of a plurality of light receiving devices arranged linearly in the sheet width direction. The linear image sensor detects the amount of misalignment of the sheet P as well as the misalignment direction. The output signal of this misalignment sensor is used to determine the displacement of the paper stop rollers 24 to perform the shifting operation.

In addition, there is a loop sensor 35 for detecting the loop amount of a sheet P conveyed between the transfer nip portion and the nip portion of the fixing unit 50 (refer to FIG. 2). The loop sensor 35 consists of a pivotable arm and a loop detector. The pivotable arm pivots at a pivoting angle which varies corresponding to the loop amount of the sheet P. The loop detector is turned on and outputs an ON signal when the pivoting angle increases to a predetermined angle, i.e., the loop amount formed of the sheet P increases to a predetermined amount.

The ambient sensor 36 is a sensor for detecting ambient information of the image forming apparatus. The ambient information detected by the ambient sensor 36 includes either or both of the ambient temperature and the ambient humidity.

A manipulation unit 60 is provided for receiving various setting information from users and outputting the setting information to the control unit 15. The manipulation unit 60 can be implemented with a touch panel through which users can input the setting information with reference to the information displayed on the panel. Users can enter printing conditions, for example, the type of a sheet P to be printed (for example, thickness, paper density and size), and the density and reduce/enlarge ratio of images through the manipulation unit 60. Also, the control unit 15 can control the manipulation unit 60 to display a variety of messages to users through this manipulation unit 60.

Figure 3:
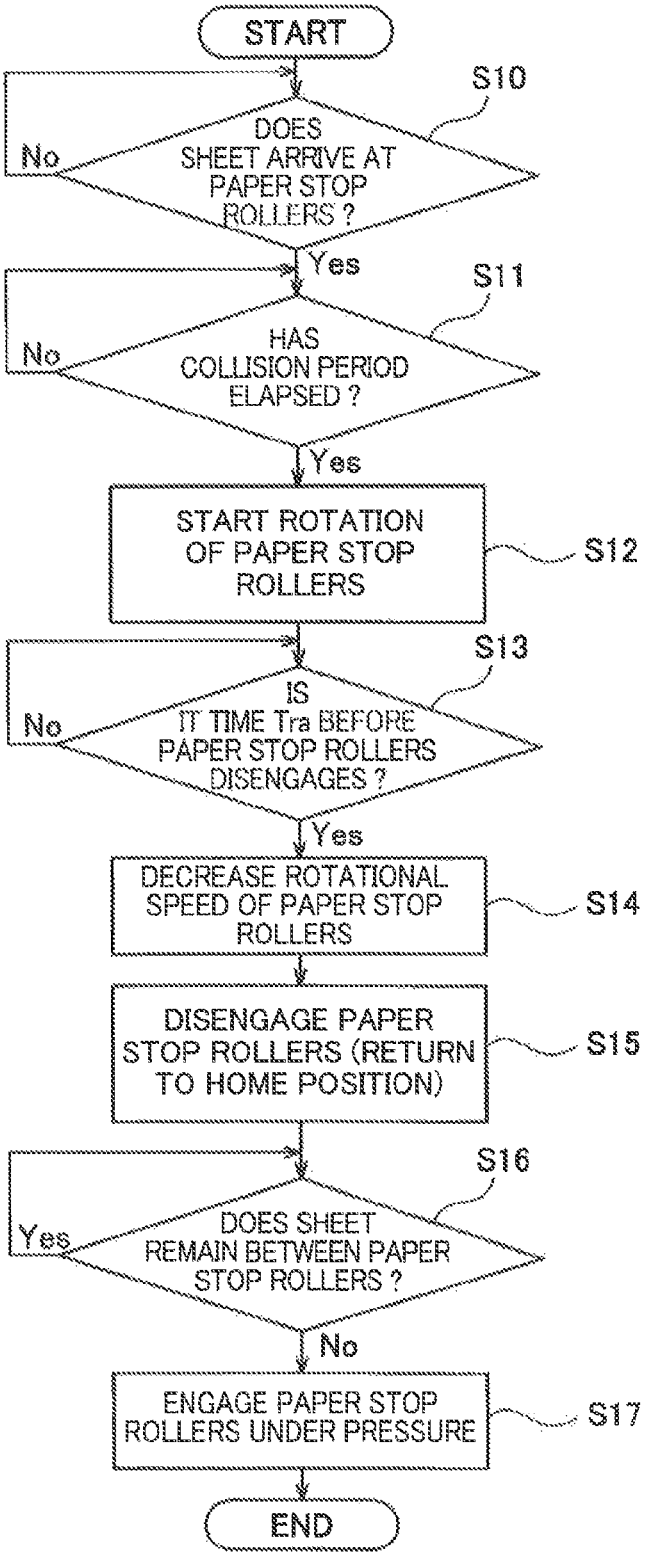
FIG. 3 is a flow chart for showing the control procedure of the image forming apparatus shown in FIG. 1.

FIG. 3 is a flow chart for showing the control procedure of the image forming apparatus according to the present embodiment, particularly, the control scheme for conveying sheets with the paper stop rollers 24. The process based on this flow chart is called when a job starts as a trigger, and performed by the control unit 15.

First, in step 10 (S10), the control unit 15 determines whether or not a sheet P arrives at the paper stop rollers 24. If the determination is in the affirmative in step 10, i.e., if a sheet P arrives at the paper stop rollers 24, the process proceeds to step 11 (S11). Conversely, if the determination is in the negative in step 10, i.e., if a sheet P does not arrive at the paper stop rollers 24 yet, step 10 is performed again.

In step 11, the control unit 15 determines whether or not a collision period has elapsed. This collision period is a period after a sheet P collides with the paper stop rollers 24 until the paper stop rollers 24 start conveying the sheet P, and predetermined according to the specifications of the image forming apparatus. If the determination is in the affirmative in step 11, i.e., if the collision period has elapsed, the process proceeds to step 12 (S12). Conversely, if the determination is in the negative in step 11, i.e., if the collision period has not elapsed yet, step 11 is performed again.

In step 12, the control unit 15 starts the rotation of the paper stop rollers 24. In this case, the control unit 15 sets the speed of conveying a sheet P passing through the paper stop rollers 24 to be higher than the speed of conveying the sheet P passing through the transfer nip portion, so that the sheet conveyed by these conveyance units is warped therebetween in the form of a loop. In addition, the control unit 15 shifts the paper stop rollers 24 from the home position in accordance with the misalignment of the sheet P.

In step 13 (S13), the control unit 15 determines whether not the current time is time Tra before the switching timing with which the pair of rollers serving as the paper stop rollers 24 are switched to the disengaged state. If the determination is in the affirmative in step 13, i.e., if the current time is time Tra before, the process proceeds to step 14 (S14). Conversely if the determination is in the negative in step 13, i.e., if the current time is not time Tra before, step 13 is performed again.

In step 14, the control unit 15 reduces the rotational speed of the paper stop rollers 24 from the current speed (the rotational speed for forming a loop between the transfer nip portion and the paper stop rollers 24). The purpose for reducing the rotational speed of the paper stop rollers 24 is to have the loop disappearing or more gentle between the transfer nip portion and the paper stop rollers 24 in advance of switching the paper stop rollers 24 to the disengaged state. Therefore an appropriate amount of speed reduction is set up in accordance with the loop amount of the sheet P in advance of starting the speed reduction. The loop amount can be calculated on the basis of the differential conveying speed between the transfer nip portion and the paper stop rollers 24, the size of the sheet P, the elapsed time before starting the speed reduction and so forth after the sheet P collides with the paper stop rollers 24.

However, the loop amount of the sheet P may vary depending upon several factors so that the speed reduction amount is variably determined in accordance with the present embodiment as described below.

A first factor is the thickness (paper density) of the sheet P. In the case where the sheet P is thinner than standard sheets having a standard thickness, the loop amount formed between the transfer nip portion and the paper stop rollers 24 tends to become greater than that of such standard sheet. It is therefore preferred for thin sheets to set a larger amount of speed reduction than for standard sheets. On the other hand, if the sheet P is thicker than standard sheets, the loop amount formed between the transfer nip portion and the paper stop rollers 24 tends to become smaller than that of standard sheets. In this case, it is therefore preferred for thick sheets to set a smaller amount of speed reduction than for standard sheets.

A second factor is the ambient condition in the image forming apparatus. When the temperature in the image forming apparatus is high, the paper stop rollers 24 expand so that the roller diameter tends to increase. In this case, the paper stop rollers 24 convey sheets P at a conveying speed which is higher than that in a usual temperature, and thereby the loop amount tends to increase. It is therefore preferred to set a larger amount of speed reduction than a standard speed reduction amount in accordance with the increase in temperature. In addition to this, when the humidity in the image forming apparatus is high, the sheet P becomes soft so that the loop amount tends to increase. Also for this reason, it is preferred to set a larger amount of speed reduction than a standard speed reduction amount in accordance with the increase in humidity.

In step 15 (S15), the control unit 15 switches the pair of rollers serving as the paper stop rollers 24 from the pressure engaged state to the disengaged state with the switching timing, followed by resetting the paper stop rollers 24 to the home position.

In step 16 (S16), the control unit 15 determines whether or not there is a sheet P between the paper stop rollers 24. If the determination is in the affirmative in step 16, i.e., there is a sheet P between the paper stop rollers 24, step 16 is performed again. Conversely, if the determination is in the negative in step 16, i.e., if a sheet P is passed through the paper stop rollers 24, the process proceeds to step 17 (S17).

In step 17, the control unit 15 switches the pair of rollers serving as the paper stop rollers 24 from the disengaged state to the pressure engaged state.

Figure 4:
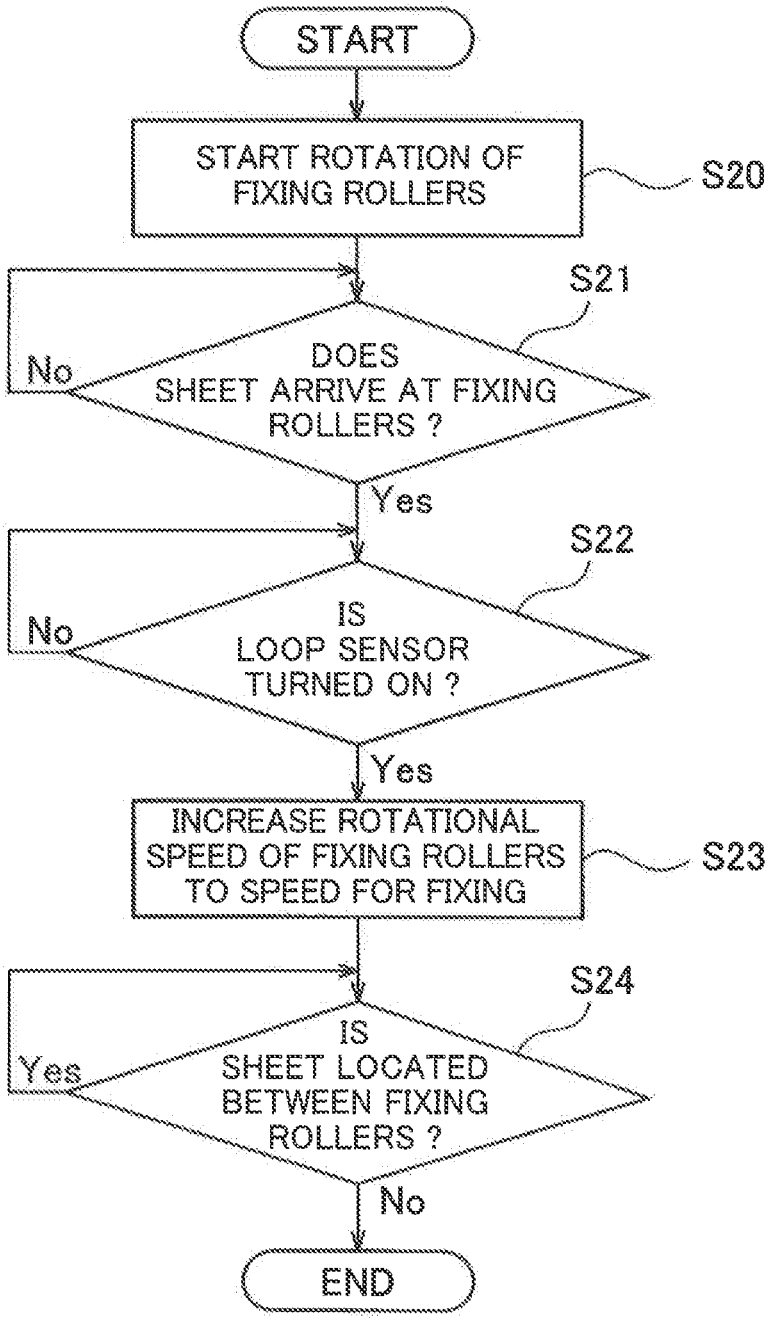
FIG. 4 is a flow chart for showing the control procedure of the image forming apparatus shown in FIG. 1.

FIG. 4 is a flow chart for showing the control procedure of the image forming apparatus according to the present embodiment, particularly, the control scheme for conveying sheets with the fixing unit 50. The process based on this flow chart is called when a job starts, and performed by the control unit 15.

First, in step 20 (S20), the control unit 15 starts the rotation of the fixing rollers 51 and 52. In this case, the control unit 15 controls the rotation of the fixing rollers 51 and 52 at a lower speed than a fixing speed, i.e., a standard speed to convey a sheet P at an appropriate conveying speed for performing the fixing treatment.

In step 21 (S21), the control unit 15 determines whether or not a sheet P arrives at the fixing rollers 51 and 52. If the determination is in the affirmative in step 21, i.e., if a sheet P arrives at the fixing rollers 51 and 52, the process proceeds to step 22 (S22). Conversely, if the determination is in the negative in step 21, i.e., if a sheet P does not arrive at the fixing rollers 51 and 52, the process repeats step 21.

In step 22, the control unit 15 determines whether or not the loop sensor 35 is on, i.e., the predetermined amount of a loop is formed of the sheet P. If the determination is in the affirmative in step 22, i.e., if the loop sensor 35 is on, the process proceeds to step 23 (S23). Conversely, if the determination is in the negative in step 22, i.e., if the loop sensor 35 is off, the process repeats step 22.

In step 23, the control unit 15 increases the rotational speed of the fixing rollers 51 and 52 from the current speed to the fixing speed.

In step 24, the control unit 15 determines whether or not there is a sheet P between the fixing rollers 51 and 52. If the determination is in the affirmative in step 24, i.e., if there is a sheet P between the fixing rollers 51 and 52, step 24 is performed again. Conversely, if the determination is in the negative in step 24, i.e., if the sheet P is passed through the fixing rollers 51 and 52, this routine returns.

As has been discussed above the control unit 15 of the present embodiment conveys the sheet P between the transfer unit and the paper stop rollers 24, while forming a loop of the sheet P therebetween, by setting the speed of conveying a sheet P passing between the paper stop rollers 24 to be higher than the speed of conveying the sheet P passing through the transfer unit. In addition to this, when the pair of rollers serving as the paper stop rollers 24 are switched from the pressure engaged state to the disengaged state as described above, the control unit 15 controls the paper stop rollers 24 to reduce the speed of conveying the sheet P through the paper stop rollers 24 in advance of this switching operation.

The loop amount of the sheet P between the paper stop rollers 24 and the transfer unit thereby decreases by the conveying speed reduction before switching the paper stop rollers 24 to the disengaged state. The stress exerted on the sheet P due to the loop formation decreases as the loop amount of the sheet P decreases, and therefore it is possible to inhibit the orientation of the sheet P during conveyance from being substantially disturbed when the sheet P is released from the paper stop rollers 24 supporting the sheet P therebetween. By this configuration, it is possible to inhibit the position of the sheet P during conveyance from being misaligned, and inhibit the image printed on the sheet in the transfer site from being disturbed.

Furthermore, in accordance with the present embodiment, a loop is formed not only between the paper stop rollers 24 and the transfer unit but also between the fixing unit 50 and the transfer unit. When a loop is formed in either section, the stress exerted on the sheet P is balanced with the loop. However, if when the paper stop rollers 24 are switched to the disengaged state with a large loop, the balance is upset so that the orientation of the sheet P during conveyance is substantially disturbed. In this regard, the present embodiment makes it possible to effectively solve such a problem by controlling the transfer unit and the paper stop rollers 24 in order to clear the loop therebetween.

Also, in order to reduce the speed of conveying a sheet P, the control unit 15 of the present embodiment variably sets the amount for the speed reduction in accordance with ambient information, i.e., the temperature and/or the humidity in the image forming apparatus.

By this configuration, since the type of a sheet P, the temperature and the humidity are taken into consideration as factors the variable loop amount, it is possible to effectively clear the loop. The orientation of the sheet P during conveyance can be thereby inhibited from being substantially disturbed. Also, by this configuration, it is possible to inhibit the position of the sheet P during conveyance from being misaligned, and inhibit the image printed on the sheet in the transfer site from being disturbed.

Meanwhile, in the case where a double-side printing job is performed, a sheet P has sometimes curled before an image is formed on the back side or the sheet P. The curl of a sheet P may thereby be taken into consideration for determining the amount of speed reduction. In this case, if the curl of a sheet P is curved in the same direction as the loop of the sheet P, the loop amount tends to increase. It is therefore preferred for such a sheet P to set a larger amount of speed reduction than for a sheet P which is not curled. The curving amount and direction of a curl can be detected by a sensor. However, since the curving amount and direction depend on the machine characteristics of the image forming apparatus, the print coverage of an image to be printed, it is possible to estimate them through experiments and simulations.

The foregoing description has been presented on the basis of the image forming apparatus according to the present invention. However, it is not intended to limit the present invention to the precise form described, and obviously many modifications and variations are possible within the scope of the invention. For example, while the above embodiment has been explained with a loop formed during conveying a sheet between a paper stop rollers and a transfer nip portion formed by an image bearing member and an image transfer member, the present invention can be generally applied to any type of conveyance units in an image forming apparatus as long as such a loop formed during conveyance.

As has been discussed above in accordance with the present invention, before switching the first conveyance unit to a disengaged state, the loop amount of a sheet between the first conveyance unit and the second conveyance unit decreases to be smaller than that before reducing the conveying speed. The stress exerted on the sheet due to the loop formation decreases as the loop amount of the sheet decreases, and therefore it is possible to inhibit the orientation of the sheet during conveyance from being substantially disturbed when the sheet is released from the first conveyance unit supporting the sheet P therebetween. By this configuration, it is possible to inhibit the position of the sheet P during conveyance from being misaligned.

What is claimed is:

1. An image forming apparatus comprising:

a first conveyance unit provided with a pair of rotary members capable of switching between a pressure engaged state and a disengaged state, and configured to convey a sheet;

a second conveyance unit located on a conveyance route of the sheet in the downstream side of said first conveyance unit, provided with a pair of rotary members, and configured to convey the sheet; and a control unit configured to control said first conveyance unit and said second conveyance unit, wherein said control unit controls said first conveyance unit and said second conveyance unit in order that the speed of conveying the sheet by said first conveyance unit is higher than the speed of conveying the sheet by said second conveyance unit so that a loop is formed between said first conveyance unit and said second conveyance unit, and that when the pair of rotary members of said first conveyance unit is switched from the pressure engaged state to the disengaged state, the speed of conveying the sheet by said first conveyance unit is reduced in advance of this switching operation, and that when the speed of conveying the sheet is reduced, said control unit variably sets an amount of speed reduction in accordance with a type of the sheet.

2. The image forming apparatus of claim 1 further comprising:

a transfer unit configured to transfer an image to the sheet; and a fixing unit configured to fix the image transferred to the sheet by said transfer unit, wherein said first conveyance unit consists of paper stop rollers located in the upstream side of said transfer unit, and wherein said second conveyance unit consists of an image bearing member and an image transfer member which are provided to form a nip portion at said transfer unit.

3. The image forming apparatus of claim 2 wherein said control unit is configured to control conveyance of the sheet in order that a loop is formed also between said transfer unit and said fixing unit.

4. The image forming apparatus of claim 2 wherein said paper stop rollers are capable of shifting from a predetermined home position as an initial position in the sheet width direction that is perpendicular to the sheet conveying direction, and wherein said control unit shifts said paper stop rollers in the sheet width direction from said home position in accordance with a position of the sheet during conveyance, switches said paper stop rollers from the pressure engaged state to the disengaged state after the sheet arrives at the nip portion of said transfer unit, and then resets said paper stop rollers to the home position.

5. The image forming apparatus of claim 1, further comprising:

a loop detector connected to said control unit and signaling said control unit when the loop formed between said first conveyance unit and said second conveyance unit reaches a predetermined amount.

6. An image forming apparatus comprising:

a first conveyance unit provided with a pair of rotary members capable of switching between a pressure engaged state and a disengaged state, and configured to convey a sheet;

a second conveyance unit located on a conveyance route of the sheet in the downstream side of said first conveyance unit, provided with a pair of rotary members, and configured to convey the sheet; and a control unit configured to control said first conveyance unit and said second conveyance unit, wherein said control unit controls said first conveyance unit and said second conveyance unit in order that the speed of conveying the sheet by said first conveyance unit is higher than the speed of conveying the sheet by said second conveyance unit so that a loop is formed between said first conveyance unit and said second conveyance unit, and that when the pair of rotary members of said first conveyance unit is switched from the pressure engaged state to the disengaged state, the speed of conveying the sheet by said first conveyance unit is reduced in advance of this switching operation, and that when the speed of conveying a sheet is reduced, said control unit variably sets an amount of speed reduction in accordance with ambient information including at least one of a temperature and a humidity in the image forming apparatus.

* * * * *